United States Patent [19]

Nishikawa et al.

[11] Patent Number: 4,960,662

[45] Date of Patent: Oct. 2, 1990

[54] POSITIVELY AND NEGATIVELY CHARGEABLE ELECTROPHOTOGRAPHIC PHOTORECEPTOR

[75] Inventors: Masayuki Nishikawa; Yumiko Komori; Masaki Yokoi; Masato Ono; Noriyoshi Takahashi; Yuzuru Fukuda; Shigeru Yagi; Ken-ichi Karakida, all of Kanagawa, Japan

[73] Assignee: Fuji Xerox Co., Ltd., Tokyo, Japan

[21] Appl. No.: 293,843

[22] Filed: Jan. 5, 1989

[30] Foreign Application Priority Data

Jan. 8, 1988 [JP] Japan ..... 63-001357

[51] Int. Cl.[5] ..... G03G 5/085

[52] U.S. Cl. ..... 430/64; 430/66; 430/84

[58] Field of Search ..... 430/65, 84, 66

[56] References Cited

U.S. PATENT DOCUMENTS

| | | | |
|---|---|---|---|
| 4,724,193 | 2/1988 | Yamazaki | 430/65 |
| 4,760,005 | 7/1988 | Pai | 430/65 |

FOREIGN PATENT DOCUMENTS

| | | |
|---|---|---|
| 59-147353 | 8/1984 | Japan . |
| 59-165066 | 9/1984 | Japan . |
| 60-112048 | 6/1985 | Japan . |
| 62-12509 | 3/1987 | Japan . |

*Primary Examiner*—John L. Goodrow

*Attorney, Agent, or Firm*—Finnegan, Henderson, Farabow, Garrett, and Dunner

[57] ABSTRACT

A positively and negatively chargeable electrophotographic photoreceptor is disclosed, comprising a substrate having thereon a charge blocking layer, an amorphous silicon photoconductive layer, and an amorphous silicon nitride surface layer provided in that order, wherein the charge blocking layer comprises of amorphous silicon nitride and the amorphous silicon photoconductive layer comprises of an i-type amorphous silicon containing 0.05 to 5.0 ppm of boron.

5 Claims, 7 Drawing Sheets

POSITIVELY AND NEGATIVELY CHARGEABLE ELECTROPHOTOGRAPHIC PHOTORECEPTOR

FIELD OF THE INVENTION

The present invention relates to an electrophotographic photoreceptor that is capable of being both positively and negatively charged.

BACKGROUND OF THE INVENTION

In recent years, various electrophotographic photoreceptors having an amorphous silicon-based photoconductive layer have been proposed. Although an electrophotographic photoreceptor having such an amorphous silicon-based photoconductive layer has excellent mechanical strength, panchromatic property and sensitivity at the longer wave length it has disadvantages in that loss of image resolution increase when it is allowed to stand under high temperature and high humidity. Moreover, the surface is changed by friction with a residual toner-removing blade or a paper strip finger in the electrophotographic process, leading to the formation of white streaks (i.e., white lines) in the image obtained. In order to overcome the above problems, it has been proposed to provide a surface layer having such a composition, e.g., Si:N, Si:O, Si:C, that does not reduce the hardness of a silicon-based photo-conductive layer (for example, JP-A-59-147353, 59-165066, 60-112048, JP-B-62-12509). (The term "JP-A" as used herein means an "unexamined published Japanese patent application", and the term "JP-B-" as used herein means an "examined Japanese patent publication").

It is said that conventionally proposed electrophotographic photoreceptors having an amorphous silicon-based photoconductive layer decreases the formation of defects such as image deletion after repeated use, and has excellent electrophotographic characteristics. Furthermore, such an amorphous silicon-based photoconductive layer can produce a high quality image for a long period of time. Conventional electrophotographic photoreceptors, however, are either positively or alternatively negatively chargeable. An electrophotographic photoreceptor which is capable of being both positively and negatively charged is not known in the art.

SUMMARY OF THE INVENTION

An object of the present invention is to provide an electrophotographic photoreceptor having an amorphous silicon-based photoconductive layer which can be both positively and negatively charged.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

The present invention provides a positively and negatively chargeable electrophotographic photoreceptor comprising a charge blocking layer on substrate. The charge blocking layer comprises amorphous silicon nitride. The charge blocking layer is covered by an amorphous silicon photoconductive layer, which comprises an i-type amorphous silicon containing 0.05 to 5.0 ppm of boron. The amorphous silicon photoconductive layer is covered by an amorphous silicon nitride surface layer. The resulting device has a bottom substrate, a charge blocking layer, an amorphous silicon photoconductive layer, and an amorphous silicon nitride surface layer, in that order.

BRIEF DESCRIPTION OF THE DRAWINGS

The accompanying drawings, which are incorporated in and constitute a part of the specification, illustrate a presently preferred embodiment of the present invention and, together with the general description given above and the detailed description of the invention given below, serve to explain the principles of the invention.

FIG. 3(*b*) is a graph showing sensitivity characteristics of the electrophotographic photoreceptor where the boron content is 0 ppm;

FIG. 3(*c*) is a graph showing sensitivity characteristics of the electrophotographic photoreceptor where the boron content is 6 ppm;

FIG. 4(*b*) depicts the surface potential of the electrophotographic photoreceptor of FIG. 4(*a*) after the image exposure;

FIG. 4(*c*) depicts the developed image of the electrophotographic photoreceptor of FIG. 4(*b*) with negatively charged toners;

FIG. 5(*b*) depicts the surface potential of the electrophotographic photoreceptor of FIG. 5(*a*) after the image exposure, and FIG. 5(*c*) depicts the developed image of the electrophotographic photoreceptor of FIG. 5(*b*) with negatively charged toners.

DETAILED DESCRIPTION OF THE INVENTION

Reference will now be made in detail to the present invention as illustrated in the accompanying drawings.

Figure 1:
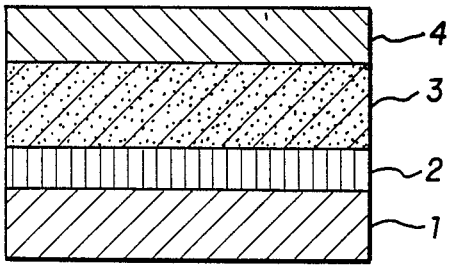
FIG. 1 is a schematic cross-sectional view of an electrophotographic photoreceptor of the present invention.

FIG. 1 is a schematic cross-sectional view of the electrophotographic photoreceptor of the present invention, including a substrate 1, a charge blocking layer 2, an amorphous silicon photoconductive layer 3, and an amorphous silicon nitride surface layer 4.

For the substrate, either an electrically conductive or insulating material can be used. When an electrically insulating substrate is used, it is necessary that at least one surface which is in contact with the other surface be electrically conductive. Electrically conductive substrates include metals and alloys, e.g., stainless steel and aluminum. Electrically insulating substrates include films or sheets e.g., polyester, polyethylene, polycarbonate, polystyrene, polyamide, glass, ceramics, paper, and the like.

The charge blocking layer on the substrate is provided for the purpose of blocking of positive or negative charge, and is made mainly of amorphous silicon nitride. The ratio (by atom) of nitrogen to silicon in the charge blocking layer is preferably from 0.4 to 1.2. Introduction of not more than 1,000 ppm of boron in the charge blocking layer is preferred because it increases the blocking properties of the negative charge and also increases the charging potential. The thickness of the charge blocking is from 0.1 to 5 μm and preferably from 0.1 to 0.5 μm.

The amorphous silicon photoconductive layer is made of i-type amorphous silicon with 0.05 to 5.0 ppm of boron added thereto. If the boron content is more than 5.0 ppm, chargability of the electrophotographic photoreceptor surface is reduced, and since electrons do not immigrate in the photoconductive layer, sensitivity is decreased in the case of negative charging. On the other hand, if the boron content is less than 0.05 ppm, positive holes do not immigrate and thus in the case of positive charging, sensitivity is decreased. Therefore, in order that the material is chargeable both positively and negatively, the boron content should be in the range of 0.05 to 5.0 ppm, and preferably is in the range of 0.5 to 5.0 ppm.

Figure 2:
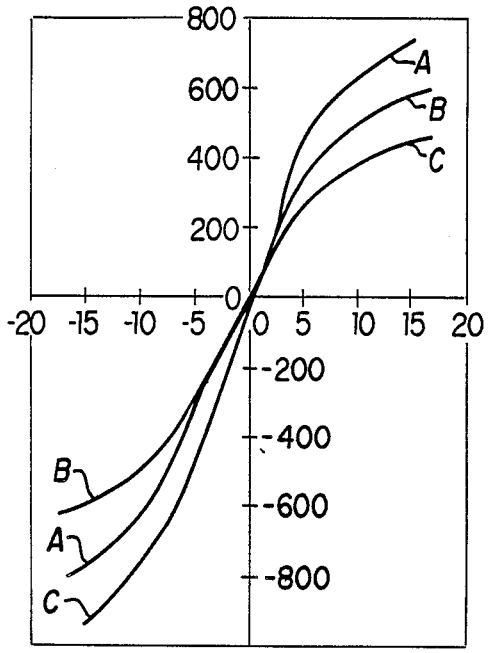
FIG. 2 is a graph showing charging characteristics of the electrophotographic photoreceptor of the present invention.
Figure 3:
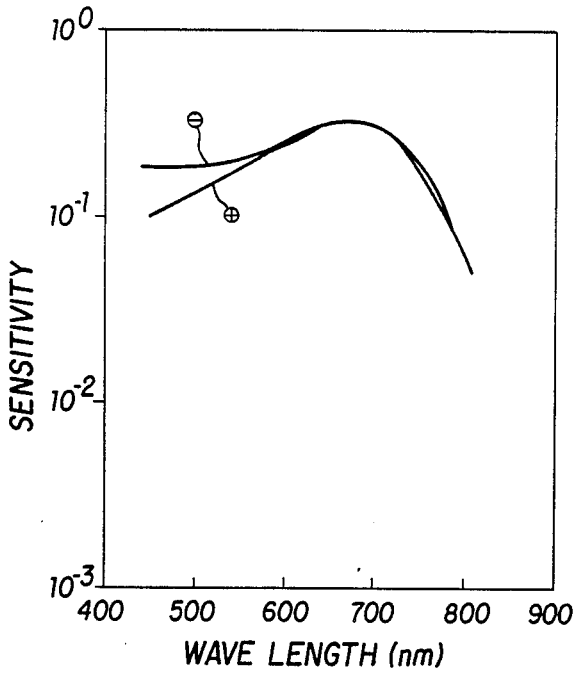
FIG. 3(*a*) is a graph showing sensitivity characteristics of the electrophotographic photoreceptor of the present invention where the boron content is 1 ppm.
Figure 3:
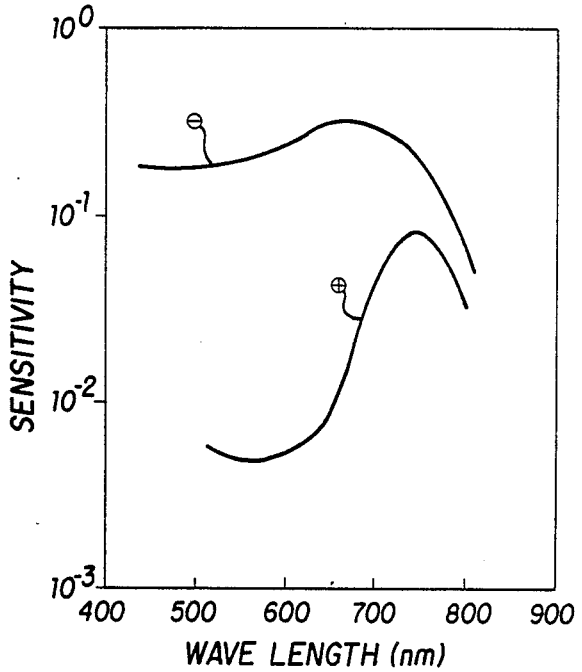
Figure 3:
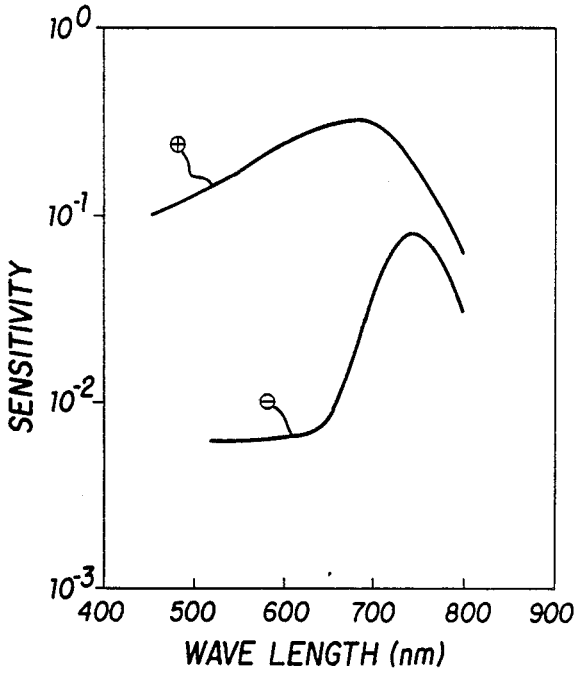

FIGS. 2, 3(*a*), 3(*b*), and 3(*c*) show that when boron is added to the amorphous silicon photoconductive layer, chargability and sensitivity are improved. That is, FIG. 2 is a graph showing charging characteristics, wherein the ordinate axis indicates surface potential and the abscissa axis indicates corotoron current. Curve A is generated by a boron content of 1 ppm, Curve B is generated by a boron content of 6 ppm, and Curve C is generated by a boron content of 0 ppm. FIGS. 3(*a*), 3(*b*), and 3(*c*) are graphs showing sensitivity characteristics, in which 3(*a*) represents a boron content of 1 ppm; 3(*b*) - represents a boron content of 0 ppm; 3(*c*) represents a boron content of 6 ppm. The ordinate axis designates sensitivity (1/E50) (E50 means a half decay exposure amount) and the abscissa axis designates wavelengths. As shown in the drawings, if boron is added to the amorphous silicon photoconductive layer in the above specified range of the present invention, both positive and negative chargability is increased and sensitivity is imparted. The thickness of the amorphous silicon photoconductive layer is preferably within the range of 5 to 50 μm.

The suface layer on the amorphous silicon photoconductive layer comprises amorphous silicon nitride as the main component. The ratio (by atom) of nitrogen to silicon in the lower region of the surface layer which is in contact with the photoconductive layer being present under the surface layer is preferably in the range from 0.3 to 0.6. In order to adjust sensitivity, residual potential, and resolution, a concentration gradient where the nitrogen concentration increases towards the surface is effective. In this case, the ratio (nitrogen/silicon) (by atom) of the upper region of the surface layer may be in the range from 0.6 to 1.2. It is preferred that not more than 1,000 ppm of boron be added to the surface layer. Incorporation of boron decreases the residual potential in negative charging and prevents image deletion due to the electric field effect. Since the charge blocking layer can have a high nitrogen content, the material to be used in its formation can be chosen from a wide variety. In the present invention, the thickness of the surface layer is in the range of generally 0.1 to 5 μm and preferably 0.1 to 0.5 μm.

An electrophotographic photoreceptor can be produced by placing a charge blocking layer, an amorphous silicon photoconductive layer, and an amorphous silicon nitride surface layer in this order on the substrate. These layers can be deposited by the glow discharge deposition method, the sputtering method, the ion plating method, the vacuum deposition method, and so forth. The film-forming method may be determined by the function of the final photoreceptor. The method in which silane ($SiH_4$) gas is decomposed to form these layers by the plasma CVD method is preferred.

Film formation of the amorphous silicon photoconductive layer by the CVD method utilizes the gaseous counterparts of silanes such as silane and disilane, or silicon crystals as starting materials. If desired, a carrier gas, e.g., hydrogen, helium, argon and neon, can also be used. In the present invention, it is necessary to add diborane($B_2H_6$) to the gaseous starting material so that the resulting amorphous silicon photoconductive layer contains 0.05 to 5.0 ppm of boron.

The charge blocking layer and the surface layer are formed in the same manner as the amorphous silicon photoconductive layer. A gaseous starting material containing a nitrogen atom such as nitrogen gas and gases of nitrogen hydride compounds, e.g., $NH_3$, $N_2H_4$ (hydrazine) and $HN_3$ (hydrogen azide), can be used.

In the case of alternating current discharging, the deposition conditions are chosen within the following ranges:

Frequency: 50 Hz to 5 GHz
Pressure in Reactor: $1\times10^{-4}$ to 5 Torr
Discharging Electric Power: 10 to 2,000 W
Temperature of Substrate: 30° to 300° C.

The thickness of each layer can be adjusted appropriately by controlling the discharging time.

The present invention is described in greater detail with reference to the following examples.

EXAMPLE 1

A mixture of silane ($SiH_4$) gas, hydrogen gas ($H_2$) and ammonia ($NH_3$) gas was subjected to glow discharge decomposition by the use of the capacity coupled type plasma CVD apparatus capable of forming an amorphous silicon film on a cylindrical support to thereby form a charge blocking layer having a thickness of about 0.3 μm on a cylindrical aluminum substrate. Deposition conditions were as follows:

Flow rate of 100% silane gas: 30 $cm^3$/min
Flow rate of 100% hydrogen gas: 200 $cm^3$/min
Flow rate of 100% ammonia gas: 30 $cm^3$/min
Pressure in reactor: 0.5 Torr
Discharge Electric Power: 50 W
Discharging time: 60 min
Discharge frequency: 13.56 MHz
Substrate temperature: 250° C.

The ratio by number of atoms of nitrogen to silicon in the charge blocking layer was about 0.6.

Next, the same discharging frequency and substrate temperature was used to form the amorphous silicon photoconductive layer. The flow rate of 100% silane gas was controlled to 200 $cm^3$/min and the flow rate of 100% hydrogen gas was controlled to 180 $cm^3$/min. While introducing diborane gas diluted with hydrogen to 100 ppm, glow discharge decomposition was carried out in the reactor at 1.0 Torr, with a discharge electric power of 300 W and a discharging time of 240 minutes. A photoconductive layer having a thickness of about 20 μm and a boron content of 2 ppm was formed on the charge blocking layer.

After the formation of the photoconductive layer, the reactor was completely evacuated, and a mixture of silane gas, hydrogen gas and ammonia gas was introduced and was subjected to glow discharge decomposition to form a surface layer having a thickness of about 0.3 μm on the photoconductive layer. The film forming conditions were as follows:

Flow rate of 100% silane gas: 30 $cm^3$/min
Flow rate of 100% hydrogen gas: 200 $cm^3$/min
Flow rate of 100% ammonia gas: 30 $cm^3$/min
Pressure in reactor: 0.5 Torr
Discharging Electric Power: 50 W
Discharging time: 60 min The ratio by number of atoms of nitrogen to silicon was about 0.6.

The electrophotographic photoreceptor thus obtained was charged to +400 V at 20° C. and a relative humidity of 15% and then exposed to measure sensitivity. At a wavelength of 550 nm, 1/E50 (E50: half decay exposure amount) was 7.3 $cm^2$/erg and the residual potential was +40 V. In the same manner as above, the material was charge to −400 V and exposed to measure sensitivity, 1/E50 was 6.5 $cm^2$/erg at a wavelength of 550 nm, and the residual potential was −40 V.

Figure 4A:
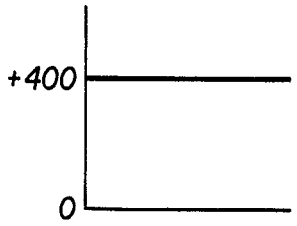
FIG. 4(*a*) depicts the surface potential of the electrophotographic photoreceptor of the present invention at per the positive charging.
Figure 4B:
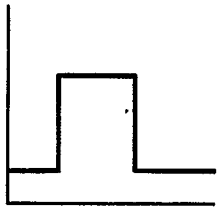
Figure 4C:
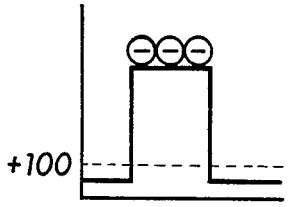

Copying was performed on the electrophotographic photoreceptor obtained above. FIGS. 4(*a*), 4(*b*), 4(*c*), 5(*a*), 5(*b*), and 5(*c*) serve to explain surface potential and the state of development when an image was formed by the use of the electrophotographic photoreceptor of the present invention. FIGS. 4(*a*), 4(*b*), and 4(*c*) represents the case where the material is positively charged, and FIGS. 5(*a*), 5(*b*), and 5(*c*) represents a case where the material is negatively charged.

The above electrophotographic photoreceptor was first uniformly charged to +400 V by the use of a corona charger (FIG. 4(*a*)), and the background was exposed to form an electrostatic latent image. The surface potential of the exposed area was +70 V, and the surface potential of the unexposed area was +380 V (FIG. 4(*b*)). Then the material was developed with negatively charged toners under a developing bias of +100 V (FIG. 4(*c*)). A sharp copied image was obtained by conducting transfer and fusing according to conventional methods.

Figure 5:
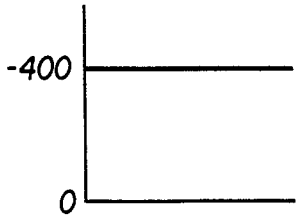
FIG. 5(*a*) depicts the surface potential of the electrophotographic photoreceptor of the present invention after the negative charging.
Figure 5B:
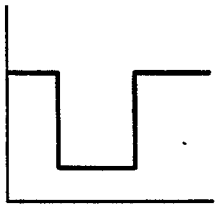
Figure 5C:
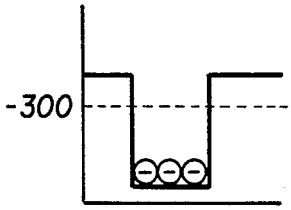

The electrophotographic photoreceptor was uniformly charged to −400 V by the use of a corona charger (FIG. 5(*a*)) and then exposed to form an electrostatic latent image. The surface potential of the exposed area was −70 V and the surface potential of the unexposed area −380 V (FIG. 5(*b*)). Then the material was developed with negatively charged toners at a developing bias of −300 V (FIG. 5(*c*)). On conducting transfer and fusing by the usual method, a sharp reversal copied image was obtained.

COMPARATIVE EXAMPLE 1

An electrophotographic photoreceptor was produced in the same manner as in Example 1 except that diboranegas was not added in the formation of the photoconductive layer. The sensitivity was measured in the same manner as in Example 1. In the case of negative charging, 1/E50 was 6.5 $cm^2$/erg at a wavelength of 550 nm. On the other hand, in the case of positive charging, 1/E50 was 100 $cm^2$/erg or more. Thus, it can be seen that the material had almost no sensitivity.

COMPARATIVE EXAMPLE 2

An electrophotographic photoreceptor was produced in the same manner as in Example 1 except that in the formation of the photoconductive layer, diborane gas was added so that the boron concentration was 6 ppm. The material was measured for sensitivity in the same manner as in Example 1. In the case of positive charging, 1/E50 was 7.0 $cm^2$/erg at a wavelength of 550 nm, and in the case of negative charging, it was more than 100 $cm^2$/erg Thus, it can be seen that the material had almost no sensitivity.

Since the electrophotographic photoreceptor of the present invention has high light sensitivity as both a positively and negatively chargeable electrophotographic photoreceptor, it provides very sharp images.

Additional advantages and modifications will readily occur to those skilled in the art. The invention in its boarder aspects is, therefore, not limited to the specific details, representative apparatus and illustrative examples shown and described. Accordingly, departures may be made from such details without departing from the spirit or scope of the general inventive concept as defined by the appended claims and their equivalents.

What is claimed is:

1. A positively and negatively chargeable electrophotographic photoreceptor comprising a substrate having thereon a charge blocking layer, an amorphous silicon photoconductive layer and a nitrided amorphous silicon layer provided in that order, wherein said charge blocking layer has a thickness of from 0.1 to 5 microns and a ratio of nitrogen to silicon by atom of from 0.4 to 1.2, said amorphous silicon photoconductive layer has a thickness of from 5 to 50 microns and comprises an i-type amorphous silicon having a boron content of from 0.05 to 5.0 ppm, and said nitrided amorphous silicon surface layer has a thickness of from 0.1 to 5 microns and a ratio of nitrogen to silicon by atom of from 0.6 to 1.2.

2. The positively and negatively chargeable electrophotographic photoreceptor as claimed in claim 1, wherein said charge blocking layer contains 1000 ppm or less of boron.

3. The positively and negatively chargeable electrophotographic photoreceptor as claimed in claim 1, wherein said charge blocking layer has a thickness in the range from 0.1 to 0.5 microns.

4. The positively and negatively chargeable electrophotographic photoreceptor as claimed in claim 1, wherein said amorphous silicon nitride surface layer contains 1000 ppm or less of boron.

5. The positively and negatively chargeable electrophotographic photoreceptor as claimed in claim 1, wherein said charge blocking layer, said amorphous silicon photoconductive layer, and said amorphous silicon nitride surface layer are deposited by the plasma CVD method.

* * * * *

UNITED STATES PATENT AND TRADEMARK OFFICE

CERTIFICATE OF CORRECTION

PATENT NO. : 4,960,662

DATED : October 02, 1990

INVENTOR(S) : Masayuki Nishikawa et al.

It is certified that error appears in the above-identified patent and that said Letters Patent is hereby corrected as shown below:

Claim 1, Column 6, Line 34, insert --surface-- before "layer".

Signed and Sealed this

Twenty-second Day of September, 1992

*Attest:*

DOUGLAS B. COMER

*Attesting Officer*

*Acting Commissioner of Patents and Trademarks*